US007636074B2

(12) United States Patent
Hamer et al.

(10) Patent No.: US 7,636,074 B2
(45) Date of Patent: Dec. 22, 2009

(54) ACTIVE MATRIX DISPLAY COMPENSATING APPARATUS

(75) Inventors: John W. Hamer, Rochester, NY (US); Gary Parrett, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 555 days.

(21) Appl. No.: 11/427,104

(22) Filed: Jun. 28, 2006

(65) Prior Publication Data

US 2008/0001854 A1 Jan. 3, 2008

(51) Int. Cl.
*G09G 3/30* (2006.01)

(52) U.S. Cl. ..... 345/76; 345/82

(58) Field of Classification Search ..... 345/76–84, 345/6

See application file for complete search history.

(56) References Cited

U.S. PATENT DOCUMENTS

| | | | | |
|---|---|---|---|---|
| 7,199,768 | B2 * | 4/2007 | Ono et al. | 345/76 |
| 2001/0024186 | A1 | 9/2001 | Kane et al. | |
| 2004/0239596 | A1 | 12/2004 | Ono et al. | |
| 2005/0068275 | A1 * | 3/2005 | Kane | 345/82 |
| 2005/0264493 | A1 * | 12/2005 | Shin | 345/76 |
| 2006/0007238 | A1 | 1/2006 | Yamamoto | |
| 2006/0066527 | A1 * | 3/2006 | Chou | 345/76 |
| 2006/0071887 | A1 * | 4/2006 | Chou | 345/82 |
| 2006/0232520 | A1 * | 10/2006 | Park et al. | 345/76 |
| 2007/0030217 | A1 * | 2/2007 | Peng | 345/76 |

FOREIGN PATENT DOCUMENTS

| | | |
|---|---|---|
| WO | 2004/097782 | 11/2004 |
| WO | 2005/069267 | 7/2005 |

OTHER PUBLICATIONS

J.H. Jung et al.; Development of a 14.1 Inch Full Color AMOLED Display with Top Emission Structure; IMID '05 Digest; pp. 793-796.
Joon-Chul Goh et al.; A New a-Si:H Thin-Film Transitor Pixel Circuit for Active-Matrix Organic Light-Emitting Diodes; IEEE Electron Device Letters, vol. 24, No. 9, Sep. 2003.

* cited by examiner

*Primary Examiner*—Alexander Eisen
*Assistant Examiner*—Nelson Lam
(74) *Attorney, Agent, or Firm*—Raymond L. Owens

(57) ABSTRACT

An apparatus for determining an adjustment to a signal voltage for compensating for changes in the threshold voltage (Vth) for a drive transistor in a pixel drive circuit in an active matrix OLED display having at least one OLED light-emitting pixel, comprising: the pixel drive circuit having a data line, a power supply line, a drive transistor; the drive transistor being electrically connected to the power supply line and to the OLED light-emitting pixel; the switch transistor being electrically connected to the gate electrode of the drive transistor and to the data line; first means for applying a first voltage to the power supply line; second means for applying a second voltage to the power supply line opposite in polarity to the first voltage; third means for producing a threshold-voltage-related signal on the data line; and fourth means responsive to the threshold-voltage-related signal for calculating the adjustment to the signal voltage.

6 Claims, 6 Drawing Sheets

ACTIVE MATRIX DISPLAY COMPENSATING APPARATUS

CROSS REFERENCE TO RELATED APPLICATIONS

The present application is related to U.S. Ser. No. 11/427,139, filed concurrently herewith, of John W. Hamer and Gary Parrett, entitled "Active Matrix Display Compensation".

FIELD OF THE INVENTION

The present invention relates to an active matrix-type display apparatus for driving display elements.

BACKGROUND OF THE INVENTION

In recent years, it has become necessary that image display devices have high-resolution and high picture quality, and it is desirable for such image display devices to have low power consumption and be thin, lightweight, and visible from wide angles. With such requirements, display devices (displays) have been developed where thin-film active elements (thin-film transistors, also referred to as TFTs) are formed on a glass substrate, with display elements then being formed on top.

In general, a substrate forming active elements is such that patterning and interconnects formed using metal are provided after forming a semiconductor film of amorphous silicon or polysilicon etc. Due to differences in the electrical characteristics of the active elements, the former requires ICs (Integrated Circuits) for drive use, and the latter is capable of forming circuits for drive use on the substrate. In liquid crystal displays (LCDs) currently widely used, the amorphous silicon type is widespread for large-type screens, while the polysilicon type is more common in medium and small screens.

Typically, organic EL elements are used in combination with TFTs and utilize a voltage/current control operation so that current is controlled. The current/voltage control operation refers to the operation of applying a signal voltage to a TFT gate terminal so as to control current between the source and drain. As a result, it is possible to adjust the intensity of light emitted from the organic EL element and to control the display to the desired gradation.

However, in this configuration, the intensity of light emitted by the organic EL element is extremely sensitive to the TFT characteristics. In particular, for amorphous silicon TFTs (referred to as a-Si), it is known that comparatively large differences in electrical characteristics occur with time between neighboring pixels, due to changes in transistor threshold voltage. This is a major cause of deterioration of the display quality of organic EL displays, in particular, screen uniformity. Uncompensated, this effect can lead to "burned-in" images on the screen.

Goh et al. (IEEE Electron Device Letters, Vol. 24, No. 9, pp. 583-585) have proposed a pixel circuit with a precharge cycle before data loading, to compensate for this effect. Compared to the standard OLED pixel circuit with a capacitor, a select transistor, a power transistor, and power, data, and select lines, Goh's circuit uses an additional control line and two additional switching transistors. Jung et al. (IMID '05 Digest, pp. 793-796) have proposed a similar circuit with an additional control line, an additional capacitor, and three additional transistors. While such circuits can be used to compensate for changes in the threshold voltage of the driving transistor, they add to the complexity of the display, thereby increasing the cost and the likelihood of defects in the manufactured product. Further, such circuitry generally comprises thin-film transistors (TFTs) and necessarily uses up a portion of the substrate area of the display. For bottom-emitting devices, the aperture ratio is important, and such additional circuitry reduces the aperture ratio, and can even make such bottom-emitting displays unusable. Thus, there exists a need to compensate for changes in the electrical characteristics of the pixel circuitry in an OLED display without reducing the aperture ratio of such a display.

SUMMARY OF THE INVENTION

It is therefore an object of the present invention to provide an apparatus and method of compensating for changes in the electrical characteristics of the pixel circuitry in an OLED display.

This object is achieved by an apparatus for determining an adjustment to a signal voltage for compensating for changes in the threshold voltage ($V_{th}$) for a drive transistor in a pixel drive circuit in an active matrix OLED display having at least one OLED light-emitting pixel, comprising:

a) the pixel drive circuit having a data line, a power supply line, a drive transistor having source, drain, and gate electrodes, and a switch transistor having source, drain, and gate electrodes;

b) the source or drain electrode of the drive transistor being electrically connected to the power supply line, and the other of the source or drain electrode being electrically connected to the OLED light-emitting pixel;

c) the source or the drain electrode of the switch transistor being electrically connected to the gate electrode of the drive transistor, and the other of the source or drain electrode being electrically connected to the data line;

d) first means for applying a first voltage to the power supply line which is either positive or negative for causing current to flow in a first direction through the drive transistor which causes the OLED light-emitting pixel to produce light in response to the signal voltage;

e) second means for applying a second voltage to the power supply line opposite in polarity to the first voltage so that current will flow through the drive transistor in a second direction opposite to the first direction until the potential on the gate electrode of the drive transistor causes the drive transistor to turn off;

f) third means for producing a threshold-voltage-related signal on the data line which is a function of the potential on the gate electrode of the drive transistor; and g) fourth means responsive to the threshold-voltage-related signal for calculating the adjustment to the signal voltage.

Advantages

It is an advantage of the present invention that it can compensate for changes in the electrical characteristics of the thin-film transistors of an OLED display. It is a further advantage of this invention that it can so compensate without reducing the aperture ratio of a bottom-emitting OLED display and without increasing the complexity of the within-pixel circuits.

DETAILED DESCRIPTION OF THE INVENTION

Figure 1:
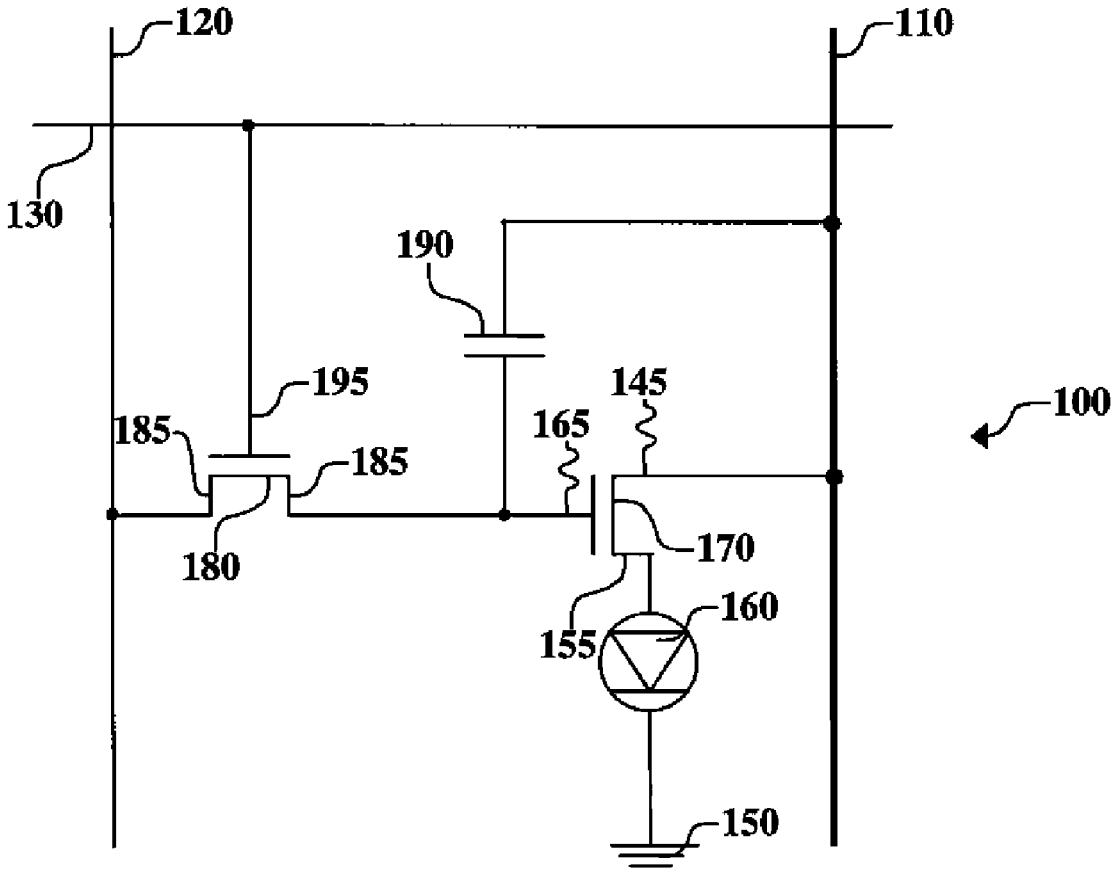
FIG. 1 shows a schematic diagram of an OLED pixel drive circuit well-known in the art.

Turning now to FIG. 1, there is shown a schematic diagram of one embodiment of an OLED pixel drive circuit that can be used in this invention. Such pixel drive circuits are well known in the art in active matrix OLED displays. OLED pixel drive circuit 100 has a data line 120, a power supply line 110, a select line 130, a drive transistor 170, a switch transistor 180, an OLED light-emitting pixel 160, and a capacitor 190. Drive transistor 170 has drain electrode 145, source electrode 155, and gate electrode 165. In pixel drive circuit 100, drain electrode 145 of drive transistor 170 is electrically connected to power supply line 110, while source electrode 155 is electrically connected to OLED light-emitting pixel 160. By electrically connected, it is meant that the elements are directly connected or connected via another component, e.g. a switch, a diode, another transistor, etc. It will be understood that embodiments are possible wherein the source and drain electrode connections are reversed. OLED light-emitting pixel 160 is a non-inverted OLED pixel, wherein the anode of the pixel is electrically connected to power line 110 and the cathode of the pixel is electrically connected to ground 150. Switch transistor 180 has gate electrode 195, as well as source and drain electrodes, together represented as source or drain electrodes 185 because such transistors are commonly bidirectional. Of the source and drain electrodes 185 of switch transistor 180, one is electrically connected to the gate electrode 165 of drive transistor 170, while the other is electrically connected to data line 120. Gate electrode 195 is electrically connected to select line 130. OLED light-emitting pixel 160 is powered by flow of current between power supply line 110 and ground 150. In this embodiment, power supply line 110 has a positive potential, relative to ground 150, for driving OLED light-emitting pixel 160. The normal driving potential will herein be referred to as the first voltage and is positive for this embodiment. It will cause current to flow through drive transistor 170 and OLED light-emitting pixel 160 in a first direction, that is, electrons will flow from ground 150 to power line 110, which will cause OLED light-emitting pixel 160 to produce light. The magnitude of the current—and therefore the intensity of the emitted light—is controlled by drive transistor 170, and more exactly by the magnitude of the signal voltage on gate electrode 165 of drive transistor 170. During a write cycle, select line 130 activates switch transistor 180 for writing and the signal voltage data on data line 120 is written to drive transistor 170 and stored on capacitor 190, which is connected between gate electrode 165 and power supply line 110.

Figure 2:
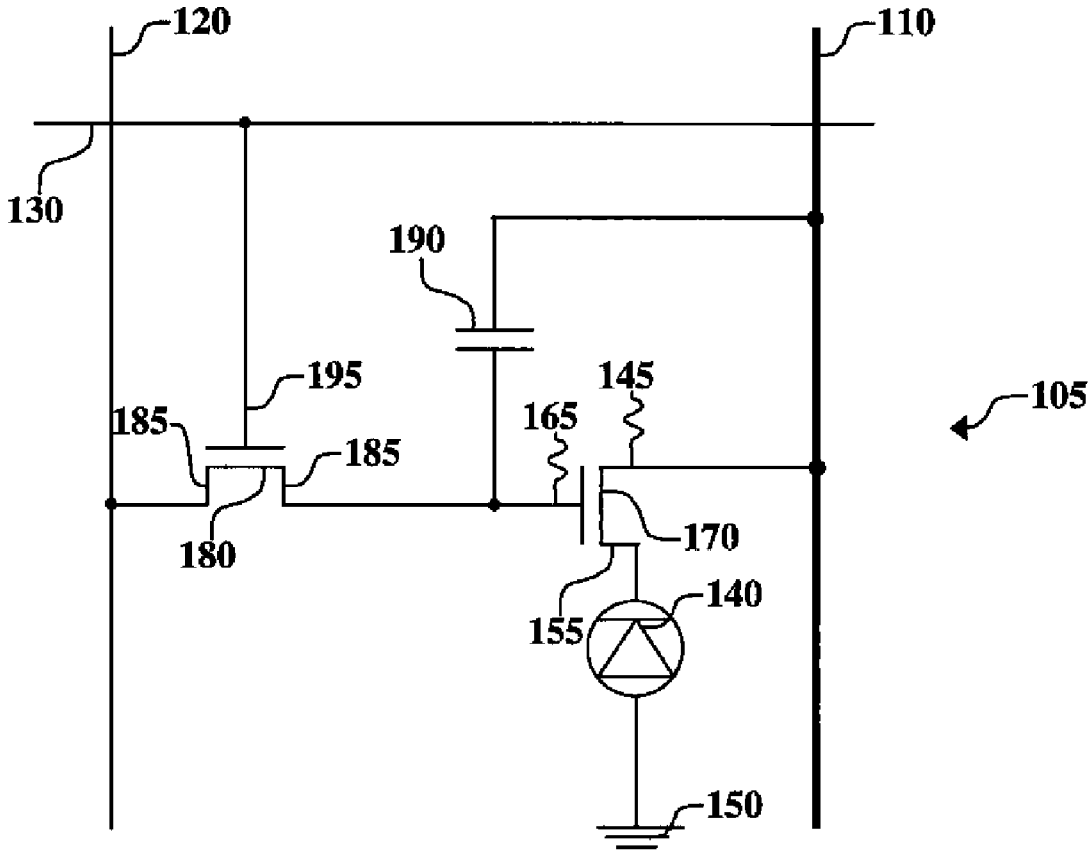
FIG. 2 shows a schematic diagram of one embodiment of a common OLED pixel drive circuit that is useful in this invention.

Turning now to FIG. 2, there is shown a schematic diagram of another embodiment of an OLED pixel drive circuit that can be used in this invention. Pixel drive circuit 105 is constructed much as pixel drive circuit 100 described above. However, OLED light-emitting pixel 140 is an inverted OLED pixel, wherein the cathode of the pixel is electrically connected to power line 110 and the anode of the pixel is electrically connected to ground 150. In this embodiment, power supply line 110 must have a negative potential, relative to ground 150, for driving OLED light-emitting pixel 160. Therefore, the first voltage is negative relative to ground 150 for this embodiment and the first direction in which current flows so as to drive OLED light-emitting pixel 140 will be the reverse of that in FIG. 1. It will be understood in the examples to follow that one can reverse the potentials and current directions if necessary for the structure and function of the OLED pixel drive circuits, and that such modifications are within the scope of this invention.

The above embodiments are constructed wherein the drive transistors and switch transistors are n-channel transistors. It will be understood by those skilled in the art that embodiments wherein the drive transistors and switch transistors are p-channel transistors, with appropriate well-known modifications to the circuits, can also be useful in this invention.

Figure 3:
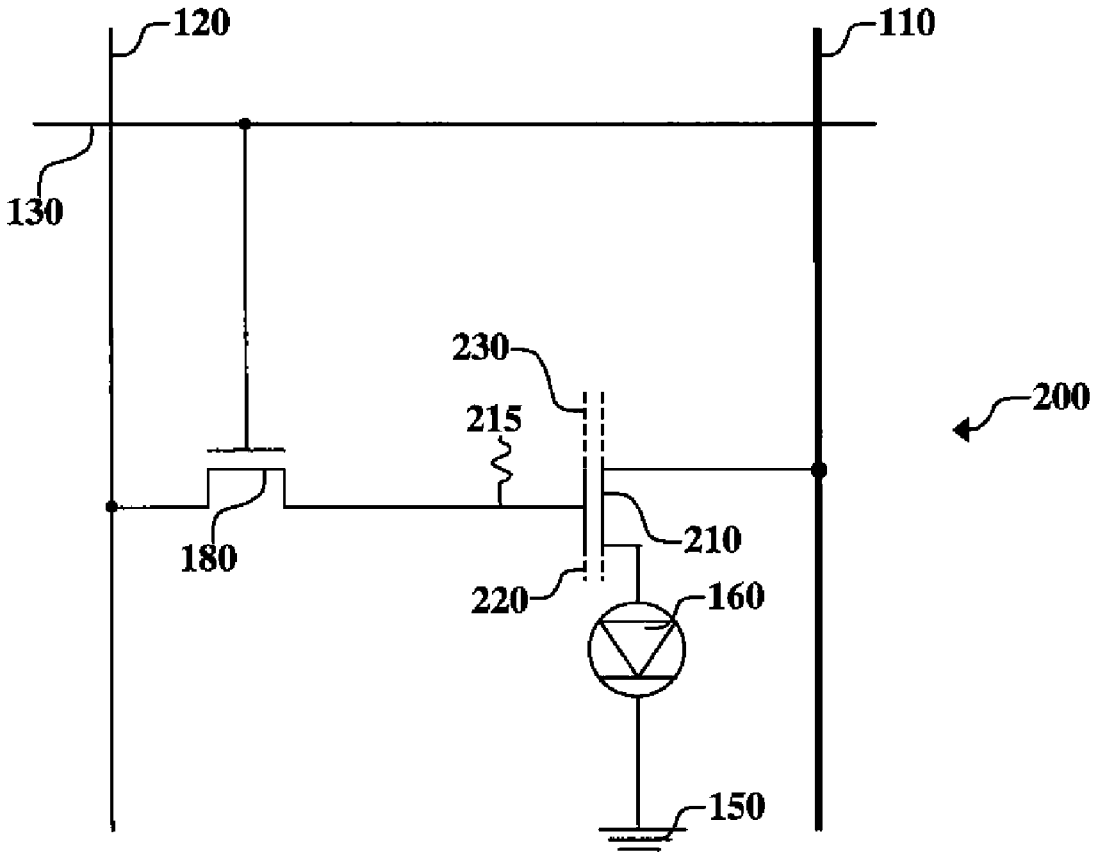
FIG. 3 shows a schematic diagram of another embodiment of a common OLED pixel drive circuit that is useful in this invention.

In practice in active-matrix displays, the capacitance is often not provided as a separate entity, but in a portion of the thin-film transistor sections that form the drive transistor. FIG. 3 shows a schematic diagram of one embodiment of a common OLED pixel drive circuit 200 of this type, which is useful in this invention. Drive transistor 210 also incorporates a capacitor 230 connected between gate electrode 215 and power line 110. This will also be referred to as the gate-power capacitor, or $C_{gp}$. Drive transistor 210 generally inherently includes a smaller parasitic capacitor 230 connected between gate electrode 215 and OLED light-emitting pixel 160. This will also be referred to as the gate-OLED capacitor, or $C_{go}$. In some embodiments, the relative magnitude of $C_{gp}$ and $C_{go}$ can be reversed. As in pixel drive circuit 100, the first voltage is positive for normal operation of OLED light-emitting pixel 160. If the potential is reversed (e.g. power supply line 110 has a negative voltage relative to ground 150), OLED light-emitting pixel 160 will be in an inoperative condition and will function instead as a capacitor having a capacitance $C_{OLED}$. This potential, which is opposite in polarity to the first voltage, will herein be referred to as the second voltage. This will cause current to flow through drive transistor 210 in a second direction opposite to the above first direction. However, current flow in the second direction will only occur until the various capacitors in the circuit, including the OLED light-emitting pixel, become charged and cause the drive transistor to turn off. The use of this property of the pixel drive circuits described herein is an important feature of this invention, which will now be illustrated.

Figure 4A:
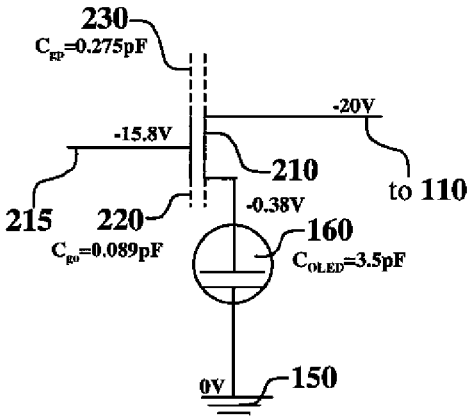
FIGS. 4A through 4D show the stepwise results of the operations of this invention on a portion of an example pixel drive circuit.

Turning now to FIGS. 4A through 4D, there are shown the stepwise results of the operations of this invention on a portion of an example pixel drive circuit 200. In preparation for FIG. 4A, a potential of zero volts is placed on power supply line 110 and on gate electrode 215. It is not required for the practice of this invention that power supply line 110 or gate electrode 215 first be set to zero volts; however, doing so will make illustration of the use of this invention clearer. The switch transistor that electrically connects gate electrode 215 to data line 120 is turned off, so that gate electrode 215 is isolated. Then a second voltage of −20V is applied to power supply line 110. With a second voltage, OLED light-emitting pixel 160 is in an inoperative condition and acts as a capacitor. In the example shown here, the OLED capacitance $C_{OLED}$ is 3.5 pF, the gate-OLED capacitance $C_{go}$ is 0.089 pF, and the gate-power capacitance $C_{gp}$ is 0.275 pF. The voltages shown in FIG. 4A are those expected with these capacitances before any current flows if the gate and power supply potentials are both initially zero. If either the gate or power supply potential—or both—is not zero, the resulting voltages will be different, but will still be a function of the capacitances.

Current will then flow through drive transistor 210 in a second direction, that is, electrons will flow from power line 110 to ground 150, and charge the $C_{OLED}$ capacitor. As the charge on $C_{OLED}$ is increased, the potential between the source and drain electrodes of drive transistor 210 is reduced. Simultaneously, the potential on the gate electrode of drive transistor 210 (which is isolated by switch transistor 180) will shift to maintain the ratio of the potential difference from the gate to source and drain in proportion to the inverse of the ratio of respective capacitances:

$$V_{gp}/V_{go}=C_{go}/C_{gp} \quad \text{(Eq. 1)}$$

Figure 4B:
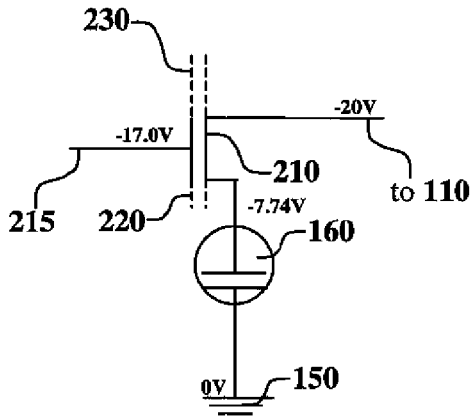

The current flow will continue until the potential $V_{gp}$ between gate electrode 215 of drive transistor 210 and power supply line 110 falls to the value of the drive transistor threshold voltage, which causes the drive transistor to turn off. By turn off, it is meant that the current flow through drive transistor 210 is substantially zero. However, it is known in the art that transistors can leak small amounts of current under threshold voltage or lower conditions; such transistors can be successfully used in this invention. For illustration purposes, we are assuming in this example that the threshold voltage $V_{th}$ of drive transistor 210 is 3.0V. FIG. 4B shows the resulting voltages stored on the capacitors at this point. These voltages are a function of the threshold voltage of the transistor. Thus, the gate voltage is a threshold-voltage-proportional signal, and can be related to the threshold voltage by Eq. 2, wherein $PV_{DD2}$ represents the second voltage (e.g. −20V in this example) applied to power supply line 110:

$$V_{gate}=PV_{DD2}+V_{th} \quad \text{(Eq. 2)}$$

After the voltages have equilibrated as shown in FIG. 4*b*, select line 130 activates switch transistor 180 to connect gate electrode 215 to data line 120, wherein the gate electrode voltage will be changed by a transfer function, here represented by f(x). The transfer function depends on the characteristics of switch transistor 180, the change in potential of select line 130, the circuit layout, the capacitance and impedance of the external circuits connected to data line 120, and the number of pixels on data line 120 that are switched. One skilled in the art can predict the transfer function based on the design, or can measure it. Thus, the voltage produced on data line 120 ($V_{out}$) is a threshold-voltage-related signal which is a function of the potential on the gate electrode of the drive transistor, given by:

$$V_{out}=f(V_{gate}) \quad \text{(Eq. 3)}$$

The transfer function f(x) can be inverted, represented by $f^{-1}(x)$. The threshold voltage is calculated from the measured voltage by:

$$V_{th}=f^{-1}(V_{out})-PV_{DD2} \quad \text{(Eq. 4)}$$

Figure 4C:
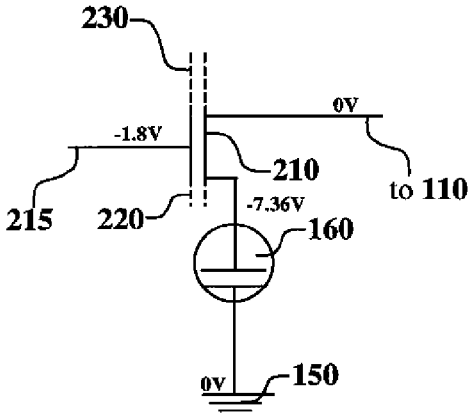
Figure 4D:
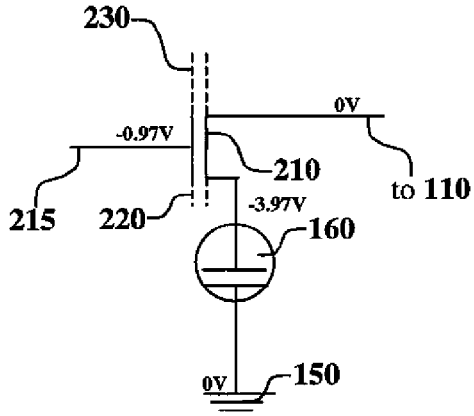

Alternatively, before activating switch transistor 180 and measuring the potentials, an additional step can be done wherein the potential of power supply line 110 can then be changed to a third voltage. This will redistribute the potentials based upon the capacitances, as shown in FIG. 4C. If the voltage is chosen correctly, such as zero in this example, current will flow through drive transistor 210 in the direction used to cause the OLED to emit light. No light will be emitted, as the OLED remains in a reverse bias condition. The current will continue to flow until the gate-to-OLED potential difference is equal to the threshold voltage of the drive transistor for current flow in the direction used for light emission. FIG. 4D shows the resulting voltages on the circuit at this point. The gate voltage can be related to the threshold voltage by:

$$V_{gate} = PV_{DD3} - \frac{V_{th}C_{gp}}{C_{go}} \quad \text{(Eq. 5)}$$

wherein $PV_{DD3}$ represents the third voltage (e.g. zero in this example) applied to power supply line 110. In this case the threshold voltage can be calculated from the measured voltage by:

$$V_{th} = \frac{-C_{go}(f^{-1}(V_{out}) - PVDD_3)}{C_{gp}} \quad \text{(Eq. 6)}$$

This last step of reducing the reverse driving potential (FIGS. 4C and 4D) is useful in the case that the threshold voltage of the driving transistor 210 is different for forward and reverse operation.

As the threshold voltage of a transistor can change with usage, it can be necessary to calculate an adjustment for the threshold voltage. This is the difference between the currently-calculated threshold voltage and the initial threshold voltage:

$$\text{Adjustment}=V_{th}-V_{thi} \quad \text{(Eq. 7)}$$

where $V_{thi}$ represents the initial threshold voltage of the transistor.

Figure 5:
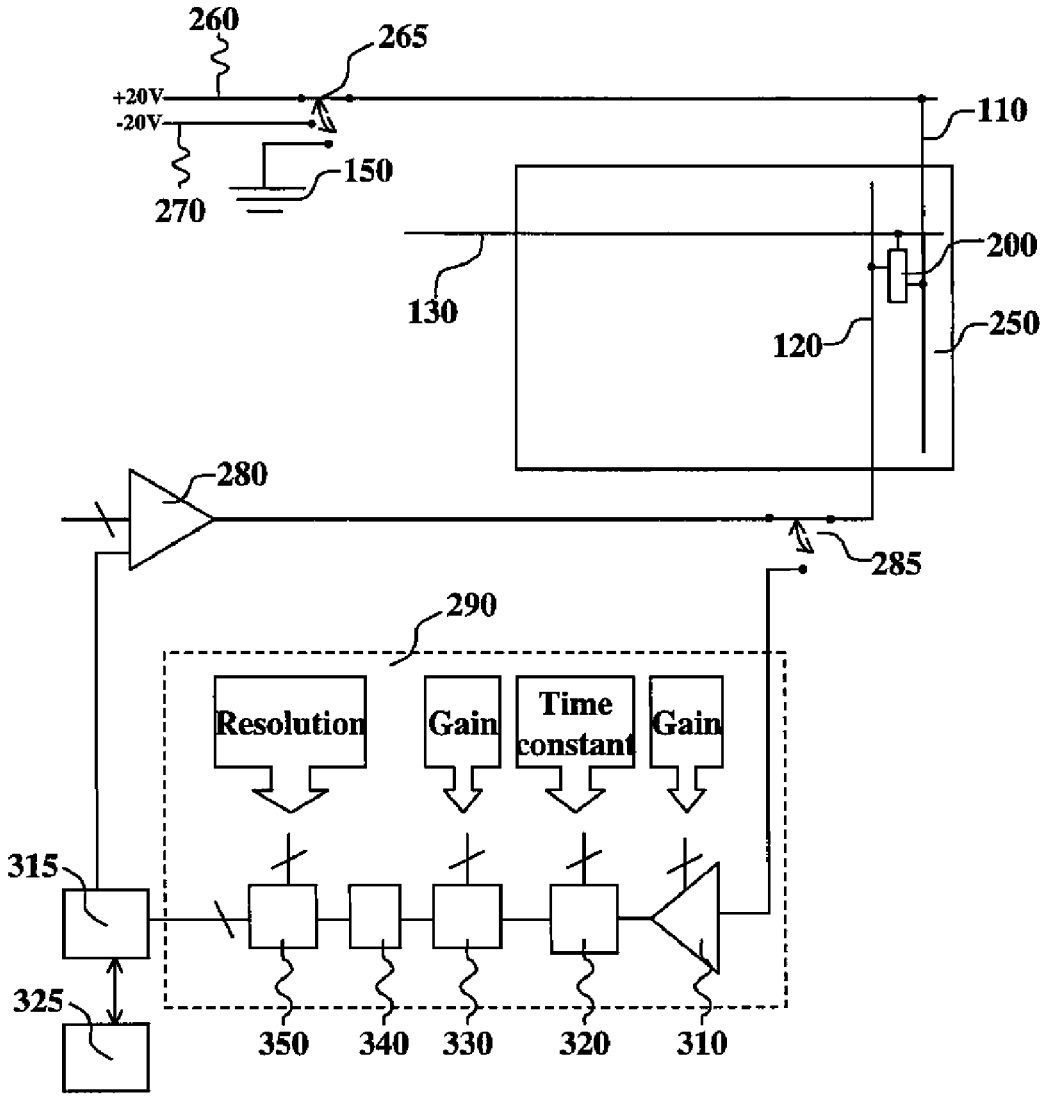
FIG. 5 shows a schematic diagram of one embodiment of a circuit according to this invention for determining an error-correcting voltage for compensating for changes in the threshold voltages for a drive transistor in a pixel drive circuit in an active matrix OLED display.

Turning now to FIG. 5, and referring also to FIGS. 3 through 4D, there is shown a schematic diagram of one embodiment of an apparatus of this invention for determining an adjustment to a signal voltage for compensating for changes in the threshold voltage for a drive transistor in a pixel drive circuit as described herein. Active matrix OLED display 250 has at least one OLED light-emitting pixel, each having a pixel drive circuit 200 as described above. In normal operation, voltage supply 260, which is a positive power supply, applies a first voltage (also called $PV_{DD1}$) to power supply line 110 via switch 265 to cause current to flow in a first direction through the drive transistor as described above, which causes OLED light-emitting pixel 160 to produce light. The intensity of the emitted light, which is proportional to the current through drive transistor 170, is responsive to the signal voltage set by data line 120, which is electrically connected to digital-to-analog converter 280. Digital-to-analog converter 280 converts a digital input representing the desired intensity of light emitted by a given pixel into an analog signal voltage, which select line 130) allows to be written to the capacitors of the selected pixel circuit. Although not shown for clarity of illustration, it will be understood that OLED display 250 can include a plurality of pixel drive circuits 200 arranged in an array, and further can include multiple power supply lines, select lines, and data lines, as known in the art.

In order to determine an adjustment to a signal voltage for compensating for changes in the threshold voltages ($V_{th}$) for the drive transistors of OLED display 250, it is necessary to apply a second voltage opposite in polarity to the first voltage to the power supply line and the pixel drive circuit and thus place the OLED in an inoperative condition, as described above. Voltage supply 270, which is a negative power supply in this embodiment, applies a second voltage ($PV_{DD2}$) opposite in polarity to the first voltage to power supply line 110 via switch 265. As described above, this causes current to flow through the drive transistor in a second direction opposite to the first direction of normal operation, until the potential on the gate electrode of the drive transistor causes the drive transistor to turn off. Switch 265 can also optionally switch the circuit to a third voltage state ($PV_{DD3}$), e.g. ground 150. During the second and third voltage operations, data line 120 can become an output line providing a threshold-voltage-related signal that is a function of the potential on gate electrode 215 of drive transistor 210. Switch 285 connects data line 120 during such data output to a correlated double sampling circuit 290 which is responsive to the threshold-voltage-related signal. In the case of multiple data lines 120, each data line can have its own correlated double sampling circuit 290, or there can be fewer correlated double sampling circuits, with multiplexing to allow sequential data sampling of all data lines. Correlated double sampling circuit 290 comprises integrator 310, low pass filter 320, correlated double sampling unit 330, sample-and-hold element 340, and analog-to-digital converter 350. Correlated double sampling circuit 290 is known and is a commercially available integrated circuit for amplification and readout of small charge over long data wires. An example is ISC9717 from Indigo. The data from correlated double sampling circuit 290 goes to a processor 315, which can store it in memory 325 as raw data, or can include computation circuitry for calculating the current threshold voltage for the drive transistor via Eq. 4 or Eq. 6, or via a lookup table. Processor 315 can calculate an adjustment to the signal voltage, via Eq. 7, from the difference between the current threshold voltage and the initial threshold voltage, which is the threshold voltage of drive transistor 210 before any aging takes place. The initial threshold voltage can be measured when pixel drive circuit 200 is new, and subsequently stored in memory. During operation of OLED display 250, processor 315 can apply the adjustment to the signal voltage through digital-to-analog converter 280, which can adjust the signal voltage, and thus apply the adjustment to data line 120, through switch transistor 180 of pixel drive circuit 200, to gate electrode 215 of drive transistor 210. Processor 315 and memory 325 can be made of individual integrated circuits or encapsulated in a single package as an SiP (System in Package). Memory 325 can also be built into processor 315 as an SoC (System on Chip).

In practice, circuits such as correlated double sampling circuit 290 make two measurements for each pixel. The first measurement is made on data line 120 without a signal, e.g. with switch transistor 180 turned off, wherein correlated double sampling circuit 290 obtains the noise level of the data line. The second measurement is made after the potentials have equilibrated, as in FIG. 4B or 4D, and switch transistor 180 has been turned on, wherein correlated double sampling circuit 290 obtains a reading of a threshold-voltage-related signal on data line 120.

Figure 6:
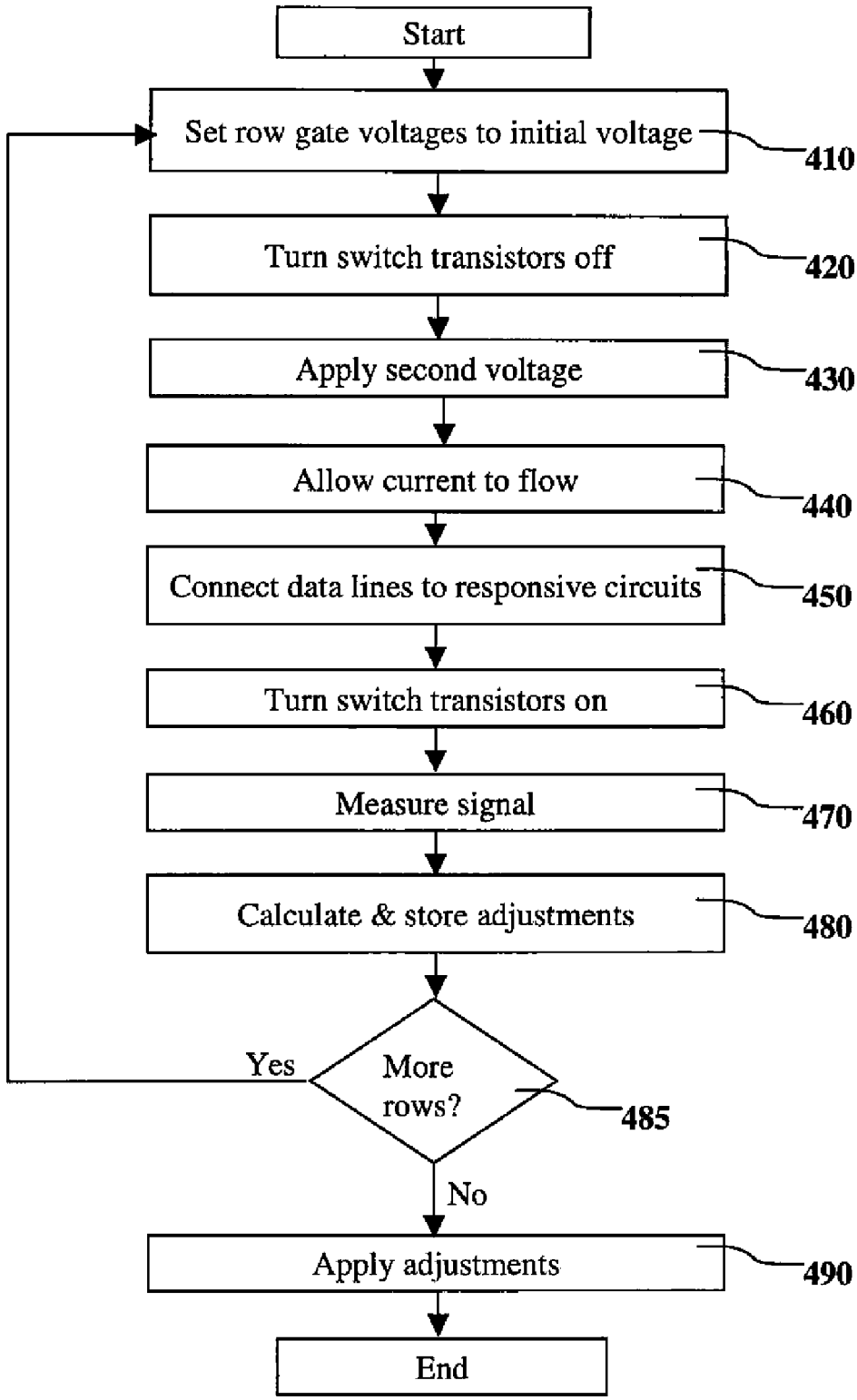
FIG. 6 shows a block diagram of one embodiment of a method according to this invention for determining an error-correcting voltage for compensating for changes in the threshold voltages for a drive transistor in a pixel drive circuit in an active matrix OLED display.

Turning now to FIG. 6, and referring also to FIGS. 3 through 5, there is shown a block diagram of one embodiment of a method using the apparatus of this invention for determining an adjustment to a signal voltage for compensating for changes in the threshold voltage for a drive transistor in a pixel drive circuit in an active matrix OLED display, and for applying the adjustment. At the start, the gate voltages of an entire row of pixel drive circuits 200 are set to the initial voltage by setting all data lines 120 to the initial voltage and turning on switch transistor 180 by selecting the appropriate select line 130 (Step 410). The initial gate voltage can conveniently be zero volts, or can be a different preselected voltage. Switch transistors 180 are then turned off (Step 420). Then a second voltage opposite in polarity to the first driving voltage is applied to OLED light-emitting pixel 160 by connecting negative voltage supply 270 to power supply line 110 via switch 265 (Step 430), thus placing the OLED in an inoperative condition. Then current is allowed to flow through the circuit (Step 440) to charge the capacitors: OLED 160, gate-OLED capacitor 220, and gate-power capacitor 230. Current flows until the potential difference across gate-power capacitor 230 equals the threshold voltage of drive transistor 210, which causes the drive transistor to turn off. The resulting voltages are as shown in FIG. 4B. Then data lines 120 are connected to the responsive circuits, e.g. correlated double sampling circuits 290 by switch 285 (Step 450), and switch transistors 180 are turned on for the row of pixel drive circuits 200 by selecting the appropriate select line 130 (Step 460). The threshold-voltage-related signal is then measured by correlated double sampling circuit 290 (Step 470). The threshold voltage $V_{th}$ is related to the threshold-voltage-related signal by Eq. 4 above. Using this equation, or a lookup table, processor 315 can calculate or find the threshold voltage and the adjustment to the signal voltage for each drive transistor 210 in the row of pixel drive circuits 200 and store one or both in memory 325 (Step 480). If there are more rows of pixel drive circuits 200 in OLED display 250 (Step 485), the process is repeated. If there are no more rows of pixel circuits, the determination of the threshold voltages is complete. Processor 315 can apply the adjustment to the signal voltage to digital-to-analog converter 280 to adjust the gate voltage on each drive transistor 210 to compensate for changes in the threshold voltage (Step 490). Step 490 need not follow immediately after Step 485. For example, Steps 410 to 485 can be done sequentially to all rows of pixel drive circuits 200 upon power-down of OLED display 250 and the adjustments stored in memory. Step 490 can then be done to all pixel drive circuits 200 the next time the display is powered on.

Those skilled in the art will understand that other embodiments are possible. For example, after Step 440, the drive voltage can be set to another voltage, such as zero, by connecting ground 150 to power supply line 110 via switch 265, after which current flows again to reach the state shown in FIG. 4D. In this case, processor 315 can use Eq. 6 above to determine the threshold voltage and the adjustment to the signal voltage in Step 480.

The invention has been described in detail with particular reference to certain preferred embodiments thereof, but it will be understood that variations and modifications can be effected within the spirit and scope of the invention.

| PARTS LIST | |
|---|---|
| 100 | pixel drive circuit |
| 105 | pixel drive circuit |
| 110 | power supply line |
| 120 | data line |
| 130 | select line |
| 140 | OLED light-emitting pixel |
| 145 | drain electrode |
| 150 | ground |
| 155 | source electrode |
| 160 | OLED light-emitting pixel |
| 165 | gate electrode |
| 170 | drive transistor |

-continued

| PARTS LIST | |
|---|---|
| 180 | switch transistor |
| 185 | source or drain electrode |
| 190 | capacitor |
| 195 | gate electrode |
| 200 | pixel drive circuit |
| 210 | drive transistor |
| 215 | gate electrode |
| 220 | capacitor |
| 230 | capacitor |
| 250 | OLED display |
| 260 | voltage supply |
| 265 | switch |
| 270 | voltage supply |
| 280 | digital-to-analog converter |
| 285 | switch |
| 290 | correlated double sampling circuit |
| 310 | integrator |
| 315 | processor |
| 320 | low pass filter |
| 325 | memory |
| 330 | correlated double sampling unit |
| 340 | sample-and-hold element |
| 350 | analog-to-digital converter |
| 410 | block |
| 420 | block |
| 430 | block |
| 440 | block |
| 450 | block |
| 460 | block |
| 470 | block |
| 480 | block |
| 485 | decision block |
| 490 | block |

What is claimed is:

1. An apparatus for compensating for changes in the threshold voltage (Vth) of a drive transistor in a pixel drive circuit in an active matrix OLED display, comprising:

a) the active matrix OLED display having a data line, a power supply line, and the pixel drive circuit, the pixel drive circuit having an OLED light-emitting pixel, a capacitor, and two transistors, a drive transistor and a switch transistor, the drive transistor having source, drain, and gate electrodes, and the switch transistor having source, drain, and gate electrodes, wherein the capacitor is connected between the gate electrode of the drive transistor and the power supply line;

b) the source or drain electrode of the drive transistor being electrically connected to the power supply line, and the other of the source or drain electrode being electrically connected to the OLED light-emitting pixel;

c) the source or the drain electrode of the switch transistor being electrically connected to the gate electrode of the drive transistor, and the other of the source or drain electrode being electrically connected to the data line;

d) a first voltage supply for selectively applying a first voltage to the power supply line which is either positive or negative for causing current to flow in a first direction through the drive transistor which causes the OLED light-emitting pixel to produce light in response to the signal voltage;

e) a second voltage supply for selectively applying a second voltage to the power supply line opposite in polarity to the first voltage so that current will flow through the drive transistor in a second direction opposite to the first direction, so that a first potential between the gate electrode and the power supply line shifts until the first potential causes the drive transistor to turn off, whereby the first potential is stored on the capacitor;

f) first means for producing a threshold-voltage-related signal on the data line which is a function of the first potential stored on the capacitor by activating the switch transistor, whereby the threshold-voltage-related signal is produced on the data line;

g) an analog-to-digital converter responsive to the threshold-voltage-related signal for producing first data corresponding to the threshold- voltage-related signal;

h) a memory for storing one or more value(s) of the first data;

i) second means for measuring a first value of the first data corresponding to an initial threshold voltage when the pixel drive circuit is new and storing the first value of the first data in the memory;

j) third means for measuring a second value of the first data corresponding to a current threshold voltage after the threshold voltage of the drive transistor has changed with usage; and k) a processor responsive to the stored first value of the first data and to the second value of the first data for receiving a signal voltage and calculating an adjustment to the signal voltage using the first and second values of the first data and for applying the adjustment to the signal voltage through the switch transistor of the pixel drive circuit to the gate electrode of the drive transistor of the pixel drive circuit to compensate for changes in the threshold voltage of the drive transistor.

2. The apparatus of claim 1 wherein the OLED light-emitting pixel is a non-inverted OLED pixel and the first voltage is positive relative to a ground value.

3. The apparatus of claim 1 wherein the OLED light-emitting pixel is an inverted OLED pixel and the first voltage is negative relative to a ground value.

4. The apparatus of claim 1 wherein the drive transistor and switch transistor are n-type transistors.

5. The apparatus of claim 1 wherein the drive transistor and switch transistor are p-type transistors.

6. The apparatus of claim 1, further including a correlated double sampling circuit responsive to the threshold-voltage-related signal.

* * * * *